US007221080B2

(12) United States Patent
Lee et al.

(10) Patent No.: US 7,221,080 B2
(45) Date of Patent: May 22, 2007

(54) FIELD EMISSION DISPLAY INCLUDING A METAL GRID

(75) Inventors: Byong-Gon Lee, Suwon (KR); Sung-Ho Jo, Seongnam (KR)

(73) Assignee: Samsung SDI Co., Ltd., Suwon-si (KR)

( * ) Notice: Subject to any disclaimer, the term of this patent is extended or adjusted under 35 U.S.C. 154(b) by 412 days.

(21) Appl. No.: 10/407,142

(22) Filed: Apr. 3, 2003

(65) Prior Publication Data

US 2003/0214226 A1 Nov. 20, 2003

(30) Foreign Application Priority Data

Apr. 3, 2002 (KR) ..... 10-2002-0018209

(51) Int. Cl.
*H01J 1/02* (2006.01)
*H01J 1/304* (2006.01)

(52) U.S. Cl. ..... 313/309; 313/495

(58) Field of Classification Search ..... 313/309, 313/495–497, 293–304, 348, 350
See application file for complete search history.

(56) References Cited

U.S. PATENT DOCUMENTS 4,900,981 A * 2/1990 Yamazaki et al. ..... 313/422
5,589,731 A * 12/1996 Fahlen et al. ..... 313/495
5,650,690 A * 7/1997 Haven ..... 313/422
5,721,468 A * 2/1998 De Zwart et al. ..... 313/422
6,252,347 B1 * 6/2001 Breen et al. ..... 313/495
6,541,905 B1 * 4/2003 Fushimi et al. ..... 313/495

FOREIGN PATENT DOCUMENTS

KR 2001-0081496 8/2001

OTHER PUBLICATIONS

Korean Patent Abstract, Publication No. 1020010081496, Published on Aug. 29, 2001, in the name of Samsung SDI Co., Ltd.

* cited by examiner

*Primary Examiner*—Mariceli Santiago
*Assistant Examiner*—Anne M Hines
(74) *Attorney, Agent, or Firm*—Christie, Parker & Hale, LLP

(57) ABSTRACT

A field emission display (FED) includes first and second substrates opposing one another with a predetermined gap therebetween. The FED also includes cathode electrodes formed in a stripe pattern on the first substrate, and a plurality of electron emission sources formed on the cathode electrodes; gate electrodes formed on the first substrate in a state insulated from the cathode electrodes and the electron emission sources by an insulating layer; and anode electrodes formed on a surface of the second substrate opposing the first substrate, and including phosphor layers formed thereon. A pair of fixing rails are formed along two opposing edges of one of the first and second substrates, the fixing rails having undergone a blackening process; and a metal grid provided between the first and second substrates and welded to an upper surface of the fixing rails.

8 Claims, 13 Drawing Sheets

FIELD EMISSION DISPLAY INCLUDING A METAL GRID

CROSS-REFERENCE TO RELATED APPLICATIONS

This application claims priority of Korean Patent Application No. 2002-0018209, filed on Apr. 3, 2002, the entire disclosure of which is incorporated by reference.

BACKGROUND OF THE INVENTION (a) Field of the Invention

The present invention relates to a field emission display. More particularly, the present invention relates to a field emission display that includes a mesh grid, and a manufacturing apparatus and a manufacturing method of the field emission display.

(b) Description of the Related Art

A field emission display (FED) is a flat panel display configuration that typically uses cold cathodes as electron emission sources to realize the display of images. FEDs generally employ a diode structure that includes cathode electrodes and anode electrodes, or a triode structure that includes cathode electrodes, anode electrodes, and gate electrodes.

A FED that employs a triode structure is described with reference to FIG. 13. The FED includes a rear substrate 1 and a front substrate 3 provided substantially in parallel with a predetermined gap therebetween. An emission structure for emitting electrons is formed on the rear substrate 1 and a phosphor structure that is excited by the emitted electrons is formed on the front substrate 3. Spacers 5 are provided between the substrates 1 and 3 to maintain the gap therebetween. The rear substrate 1 and the front substrate 3 are sealed in a state where a vacuum is formed in the gap between these elements.

In more detail, electrons are emitted from electron emission sources 9 by a difference in voltage applied to cathode electrodes 7 and gate electrodes 15. Also, a high voltage is applied to anode electrodes 11 such that the electrons are accelerated toward phosphor layers 13. The electrons strike the phosphor layers 13 to excite the same.

During the above operation, it is possible for arc discharge to occur within the FED by the high voltage applied to the anode electrodes 11 and the small gap (i.e., cell gap) between the substrates 1 and 3. If a short occurs between the gate electrodes 15 and the anode electrodes 11 as a result of such arc discharge, the high voltage of the anode electrodes 11 is applied to the gate electrodes 15 which may damage a drive circuit of the FED.

To prevent this problem, a grid substrate may be mounted between the rear substrate 1 and the front substrate 3. The applicant discloses a metal grid as a grid substrate in Korean Laid-Open Patent Application No. 2001-0081496. The metal grid (indicated by reference numeral 17 in FIG. 13) is a mesh grid electrode made of metal.

The metal grid 17 is low in cost (compared to other types of grid substrates that are made of photosensitive glass) and is easily made in large sizes. However, manipulation of the metal grid is difficult. For example, it is difficult to adhere the metal grid 17 to a glass substrate, that is, the rear substrate 1 and the front substrate 3.

Further, to mount the metal grid 17 in a flat configuration to a substrate, it is necessary that the metal grid 17 be formed to a thickness that exceeds a predetermined amount. However, it is difficult to form the metal grid 17 to a thickness that is greater than or equal to 100 μm in order to allow for the formation of minute holes (of a diameter of less than or equal to 100 μm) by a chemical etching process.

The metal grid 17 is generally made of an alloy stainless steel sheet that contains chrome (for example, a 42-6 alloy-42% Ni, and 6% Cr, Fe, etc.). When attaching the metal grid 17 formed in this manner to a glass substrate, in order to securely and closely attach these elements, a blackening process is performed on the alloy stainless steel sheet to form an oxidation film on its surface, after which a crystallized glass (frit) is used as an adherent to attach the metal grid to the glass substrate through a baking process.

The two different types of oxidation materials used for the oxidation films include the spinel-type oxidation material $(Mn,Fe)O.Cr_2O_3$ and the corundum-type oxidation material $(Cr_2O_3)$. With respect to the spinel-type oxidation material, part of the oxidation material frit is diffused to increase the chemical attraction between the oxidation film and the frit, and with respect to the corundum-type oxidation material, the airtight seal and contact strength between the parent metal and the oxidation film are increased.

Accordingly, when the metal grid is heat-treated or is otherwise manipulated (e.g., attached to other elements), there is a high possibility that the metal grid will be deformed. Therefore, in the prior art FED described above, the metal grid is securely mounted, then spacers are provided in the FED to maintain the cell gap between the substrates.

However, since the spacers are mounted passing through the metal grid, it is possible for the spacers to be misplaced by the different degrees of thermal expansion between the glass substrate and metal grid or by shock given to the FED during assembly. This may result in the metal grid sagging or otherwise becoming deformed.

SUMMARY OF THE INVENTION

In one embodiment, the present invention is a field emission display, in which a metal grid is stably provided between two substrates.

Other embodiments of the present invention include a field emission display, a manufacturing apparatus, and a manufacturing method of the field emission display, in which deformation of a metal grid is prevented during assembly of the field emission display.

In one embodiment, the present invention is a field emission display including first and second substrates opposing one another with a predetermined gap therebetween; cathode electrodes formed on the first substrate; gate electrodes formed on the first substrate and insulated from the cathode electrodes by an insulating layer; anode electrodes formed on a surface of the second substrate opposing the first substrate, and including phosphor layers formed thereon; at least a pair of fixing rails formed along one of opposing edges of the first and second substrates, the fixing rails having undergone a blackening process; and a metal grid provided between the first and second substrates and welded to an upper surface of the fixing rails.

The present invention also provides a field emission display including first and second substrates provided opposing one another with a predetermined gap therebetween; cathode electrodes formed on the first substrate; gate electrodes formed on the first substrate and insulated from the cathode electrodes by an insulating layer; anode electrodes formed on a surface of the second substrate opposing the first substrate, and including phosphor layers formed thereon; at least a pair of grid holders formed along one of opposing edges of the first and second substrates; a plurality of fixing brackets formed on the grid holders, the fixing brackets having undergone a blackening process; and a metal grid provided between the first and second substrates and welded to an upper surface of the fixing brackets.

In one embodiment, the present invention is an apparatus for manufacturing a field emission display including a metal grid and a plurality of fixing elements. The apparatus includes a plurality of magnetic elements provided to an upper surface of the metal grid before performing welding to secure the metal grid to the fixing elements using magnetic force; and a support assembly for securing the magnetic elements.

In one embodiment, the present invention is a method for manufacturing a field emission display including providing a plurality of fixing rails on one of two opposing surfaces of first and second substrates, the fixing rails having undergone a blackening process; placing a metal grid on the a plurality of fixing rails, and positioning magnetic elements on the metal grid such that the metal grid is secured on the a plurality of fixing rails by a magnetic force of the magnetic elements; welding the metal grid to the a plurality of fixing rails; and cutting the metal grid at areas not corresponding to a pixel region.

In one embodiment, the present invention is a method for manufacturing a field emission display includes providing a plurality of grid holders on one of two opposing surfaces of first and second substrates, and attaching fixing brackets that have undergone a blackening process to an upper surface of the a plurality of grid holders; placing a metal grid on the fixing brackets, and positioning magnetic elements on the metal grid such that the metal grid is secured on the fixing brackets by a magnetic force of the magnetic elements; welding the metal grid to the fixing brackets; and cutting the metal grid at areas not corresponding to a pixel region.

BRIEF DESCRIPTION OF THE DRAWINGS

The accompanying drawings, which are incorporated in and constitute a part of the specification, illustrate various embodiments of the invention, and, together with the description, serve to explain the principles of the invention.

DETAILED DESCRIPTION

Embodiments of the present invention will now be described in detail with reference to the accompanying drawings. It is to be understood that the structure of the present invention is useful not only for field emission displays, but also for similar flat panel displays, such as vacuum fluorescent displays.

Figure 1:
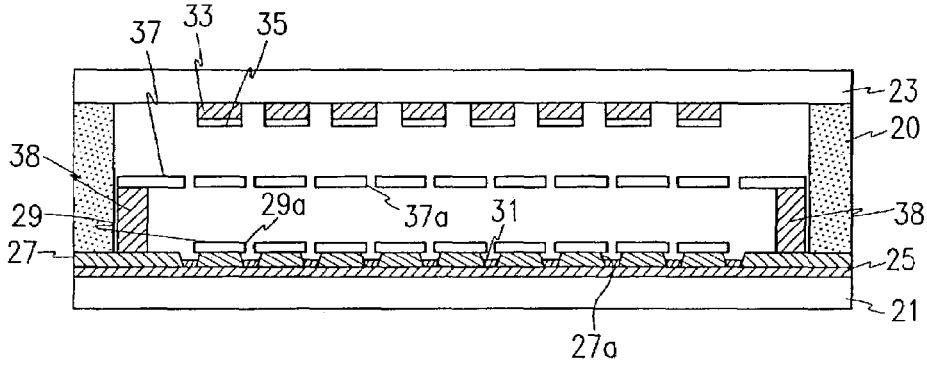
FIG. 1 is a sectional view of a field emission display according to a first embodiment of the present invention.
Figure 1A:
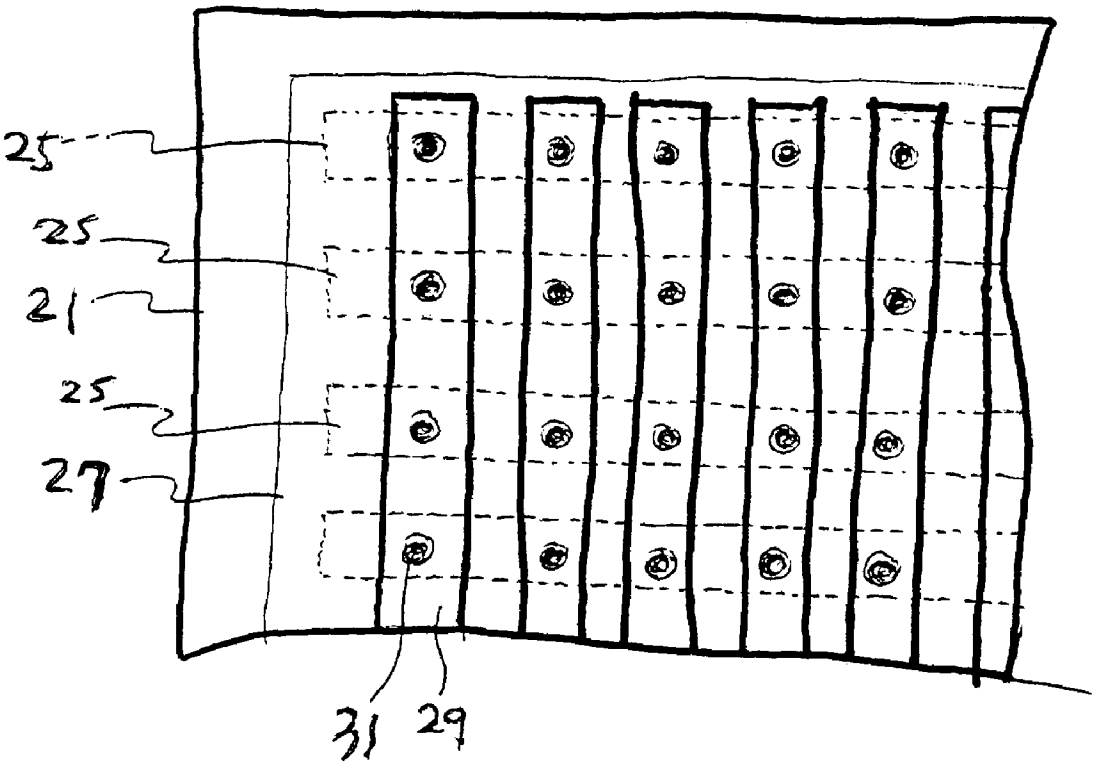
FIG. 1A is a schematic top view of the field emission display disclosed herein.

FIG. 1 is a sectional view and FIG. 1A is a top view of a field emission display according to a first embodiment of the present invention.

With reference to the drawings, the field emission display (FED) includes a first substrate 21 of predetermined dimensions (hereinafter referred to as a rear substrate) and a second substrate 23 of predetermined dimensions (hereinafter referred to as a front substrate). The front substrate 23 is provided substantially in parallel with the rear substrate 21 with a predetermined gap therebetween. The front substrate 23 and the rear substrate 21 are connected in this configuration to define an exterior of the FED and to form a vacuum assembly.

An emission structure to enable the emission of electrons by an electric field is formed on the rear substrate 21, and an illumination structure to enable the realization of predetermined images by interaction with electrons is formed on the front substrate 23.

In more detail, for the emission structure, cathode electrodes 25 are formed in a stripe pattern, and an insulation layer 27 is formed over an entire surface of the rear substrate 21 covering the cathode electrodes 25, as shown in FIG. 1A. Further, gate electrodes 29 are formed in a stripe pattern on the insulation layer 27. Holes 29*a* and 27*a* are formed in the gate electrodes 29 and the insulation layer 27, and electron emission sources 31 are formed on the cathode electrodes 25 on the same areas being exposed through the holes 29*a* and 27*a*.

With respect to the illumination structure for realizing predetermined images, anode electrodes 33 are formed on a surface of the front substrate 23 opposing the rear substrate 21. Also, phosphor layers 35 are formed on the anode electrodes 33. The phosphor layers 35 are illuminated by electrons emitted from the electron sources 31 of the rear substrate 21.

With this structure, if electrons are emitted from the electron emission sources 31 by the voltage difference between the cathode electrodes 25 and the gate electrodes 29, the electrons are attracted by a high voltage applied to the anode electrodes 33 to strike the phosphor layers 35 and excite the same.

A metal grid 37 is mounted between the front substrate 23 and the rear substrate 21 to prevent arc discharge between these elements and to aid in focusing the emitted electrons. Preferably, the metal grid 37 includes a plurality of apertures 37*a*, each aperture 37*a* corresponding to one electron emission source 31.

To mount the metal grid 37, fixing elements, such as fixing rails 38 that have already undergone a blackening process are secured to a surface of the rear substrate 21 opposing the front substrate 23. Each of the fixing rails 38 is formed in a shape of a rod having a predetermined height, and the fixing rails 38 are attached to the rear substrate 21 using frit along at least two opposing edges of the rear substrate 21. The metal grid 37 is then fixed to an upper surface (in the drawing) of the fixing rails 38. One example of fixing the metal grid to the fixing rails is by laser welding.

The fixing rails 38 and the metal grid 37 are made of an alloy stainless steel sheet that has undergone a blackening process (e.g., a 42-6 alloy) as described with reference to the prior art.

Figure 2:
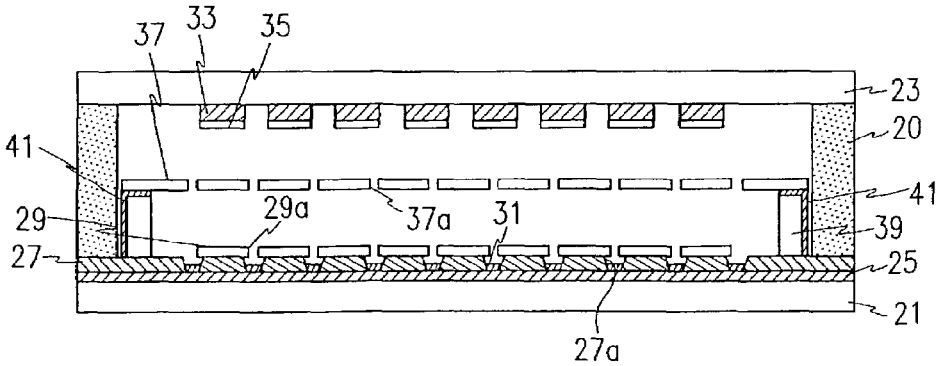
FIG. 2 is a sectional view of a field emission display according to a second embodiment of the present invention.

FIG. 2 is a sectional view of a field emission display according to a second embodiment of the present invention. The second embodiment has the below-mentioned modified structures on the basis of the first embodiment.

In this embodiment, to mount the metal grid 37, grid holders 39 made of glass are secured to a surface of the rear substrate 21 opposing the front substrate 23. Fixing elements, such as fixing brackets 41, which have already undergone a blackening process, are attached to the grid holder 39 using frit, after which baking is performed. The metal grid 37 is then fixed to an upper surface of the fixing brackets 41 by welding such that the fixing brackets 41 can withstand a horizontal stress of the metal grid 37, which is mounted in a tensed state. In this configuration, each of the fixing brackets 41 is bent at a substantially right angle and fixed to the grid holder 39.

The fixing brackets 41 are made of an alloy stainless steel sheet that has undergone a blackening process (e.g., a 42-6 alloy) as described with reference to the prior art.

The FED, structured as in the above, is realized using a manufacturing apparatus as described below.

Figure 3:
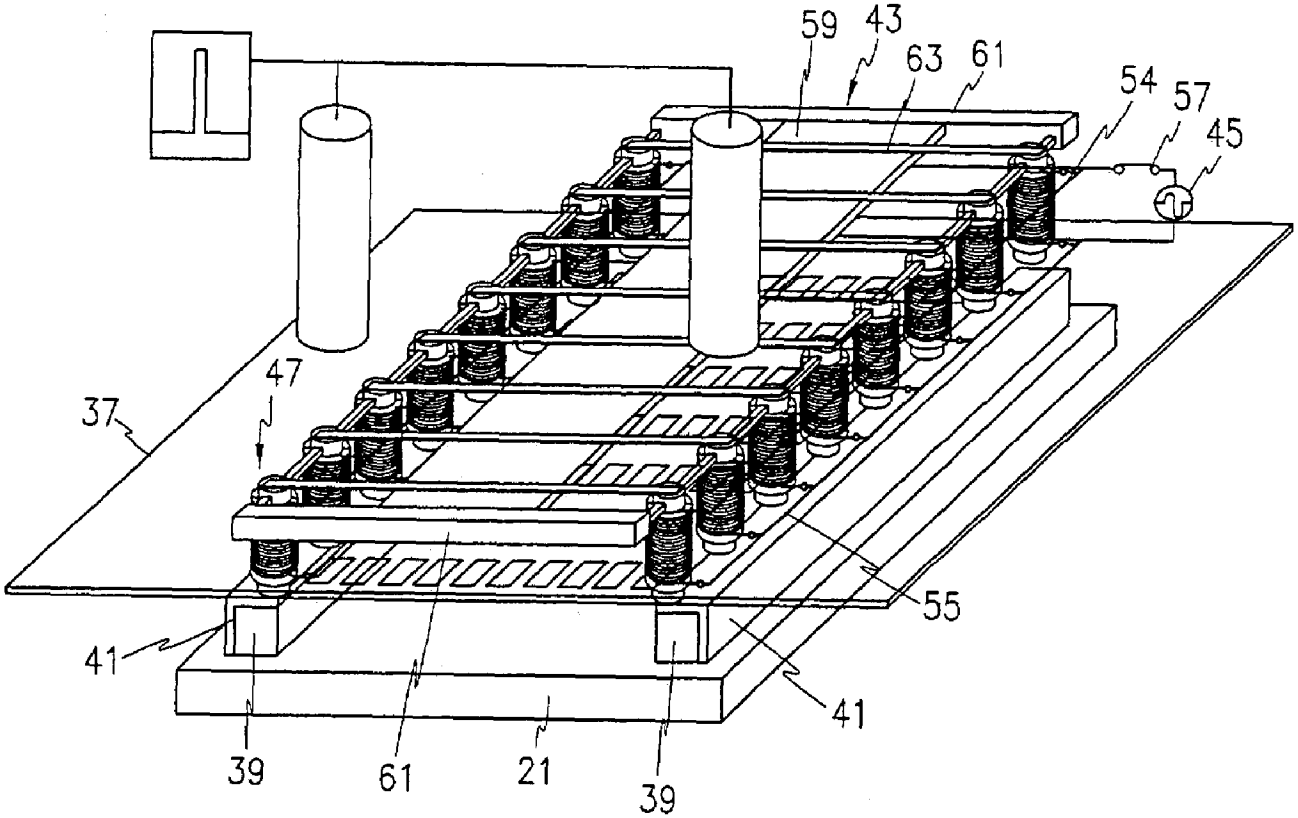
FIG. 3 is a perspective view of a manufacturing apparatus for a field emission display according to a first embodiment of the present invention.

With reference to FIG. 3, a manufacturing apparatus according to a first embodiment of the present invention includes magnetic elements, a support assembly 43 for securing the magnetic elements, and a power supply 45 for supplying power to the magnetic elements. Permanent magnets or electromagnets may be used for the magnetic elements. In the following description, it is assumed that the magnetic elements are electromagnets 47, which operate by power supplied from the power supply 45.

Figure 4:
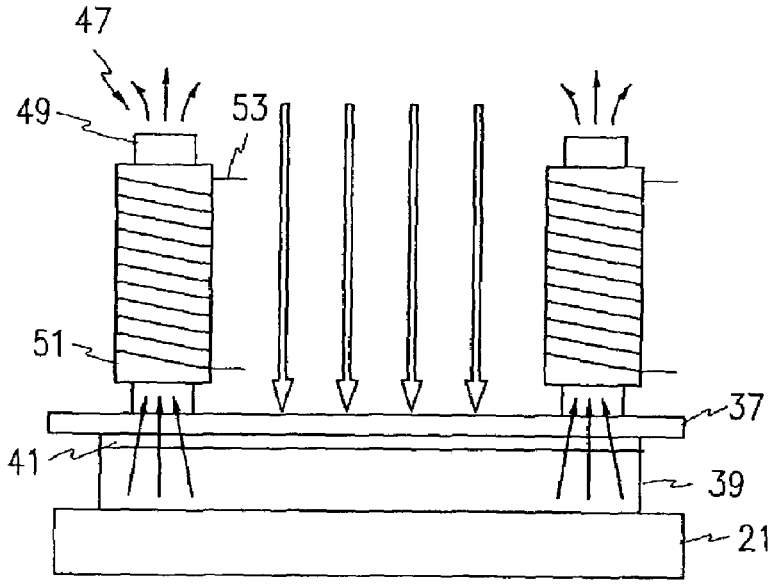
FIG. 4 is a side view of the manufacturing apparatus of FIG. 3.

With reference to FIG. 4, each of the electromagnets 47 is formed by surrounding a core 49 with an insulator 51, then winding an electric wire 53 around an exterior of the insulator 51 a number of times to form a coil. The core 49 is made of a material with a high magnetic susceptibility that is magnetized by an external magnetic field.

With the electromagnets 47 structured in this manner, if power is applied to the electric wire 53 to form a closed circuit, a magnetic field is generated in the electromagnet 47 because of the wound electric wire 53, while current is flowing. If a direction of the current is reversed, the direction of the magnetic field is reversed.

The strength of the magnetic field at a center of the core 49 is proportional to the number of coil windings, the amount of current, and the magnetic susceptibility of the material of the electromagnet 47.

A plurality of the electromagnets 47 structured as in the above are interconnected for use as an electromagnet assembly. For such interconnections, input terminals and output terminals of the coil are connected respectively to an input bus electrode 54 and an output bus electrode 55. The bus electrodes 54 and 55 are connected to opposite ends of the power supply 45. Also, a switch 57 is provided between one of the two bus electrodes 53 and 55 and the power supply 45.

The support assembly 43 that secures the electromagnets 47 includes support bars 61 provided to opposite sides of a support plate 59 located between the two rows of the electromagnets 47; and fixing rods 63 provided at predetermined intervals on an upper surface of the support plate 59 and substantially perpendicular to a long axis direction of the support plate 59. An electromagnet 47 is secured to each end of each of the fixing rods 63.

Figure 5:
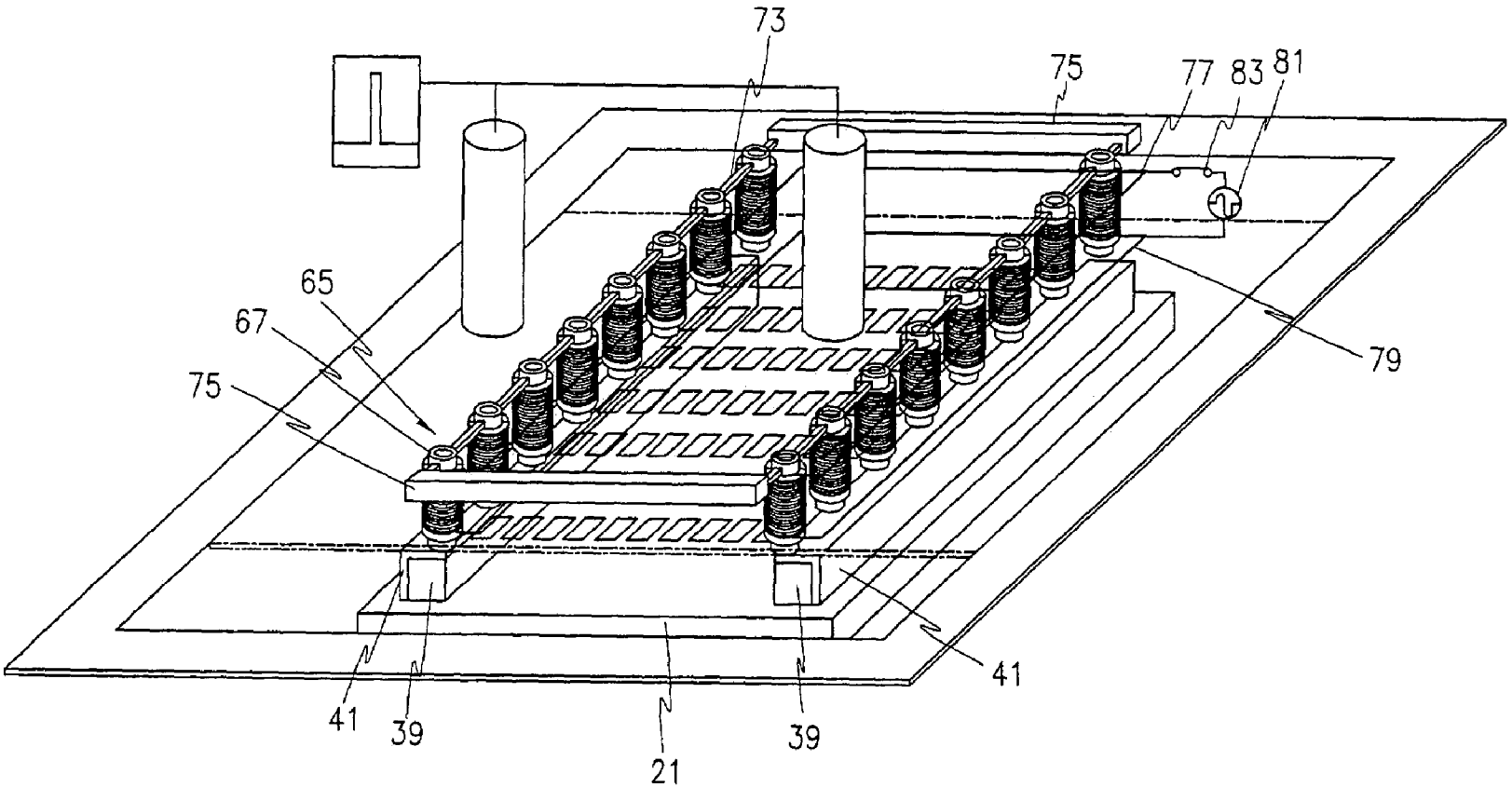
FIG. 5 is a perspective view of a manufacturing apparatus for a field emission display according to a second embodiment of the present invention.
Figure 6:
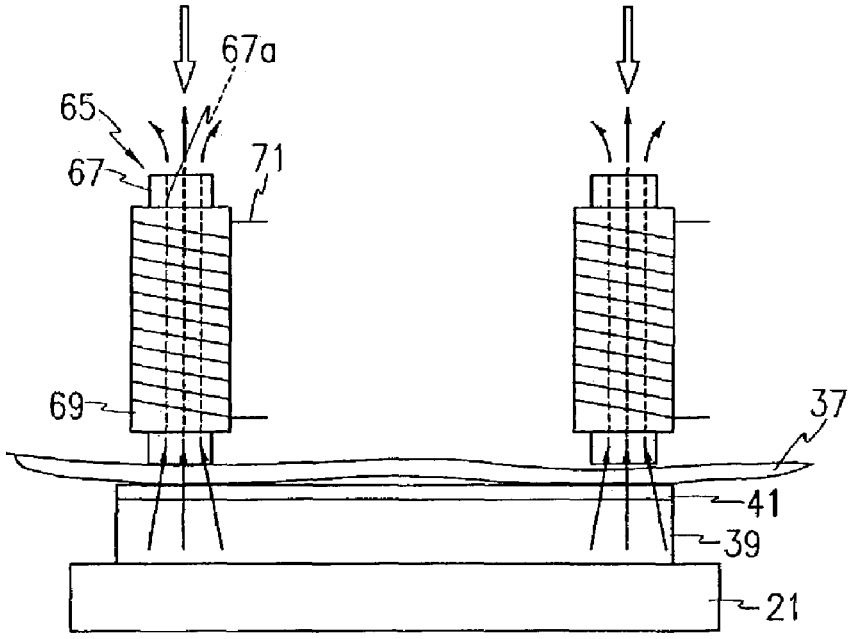
FIG. 6 is a side view of the manufacturing apparatus of FIG. 5.

The above manufacturing apparatus is used when welding points occur between the electromagnets 47, as shown in FIG. 4. However, when welding points correspond to a center of the cores, a manufacturing apparatus according to a second embodiment of the present invention may be used. This manufacturing apparatus is shown in FIGS. 5 and 6. The second embodiment of the present invention is used when areas of the metal grid 37 corresponding to between electromagnets 65 are bent and loosened from the top surface of the fixing brackets. That is, the second embodiment enables welding where the electromagnets 65 are located so that the bent areas may be avoided.

Insulators 69 and electric wires 71 of the electromagnets 65 of the second embodiment are formed identically as the same elements of the electromagnets 47 of the first embodiment therefore, a detailed explanation of the insulators 69 and the electric wires 71 will not be provided in the following. However, cores 67 of the electromagnets 65 are formed differently from the same element of the electromagnets 47 of the first embodiment of the present invention.

The cores 67 include passage holes 67*a* formed in a center of the cores 67. The passage holes 67*a* allow laser beams to be passed through the electromagnets 65 to perform welding.

A plurality of the electromagnets 65 structured as in the above are interconnected for use as an electromagnet assembly. To realize such a configuration, a connecting rod 73 is secured to upper ends of the cores 67 of the electromagnets 65 forming each row of the same. Then, ends of the resulting two connecting rods 73 are connected through support bars 75. Further, the structure of input bus electrodes 77, output bus electrodes 79, a power source 81, and a switch 83 is identical to that described with reference to the first embodiment of the present invention.

A method of manufacturing a field emission display according to the first embodiment of the present invention I is now described.

Figure 7:
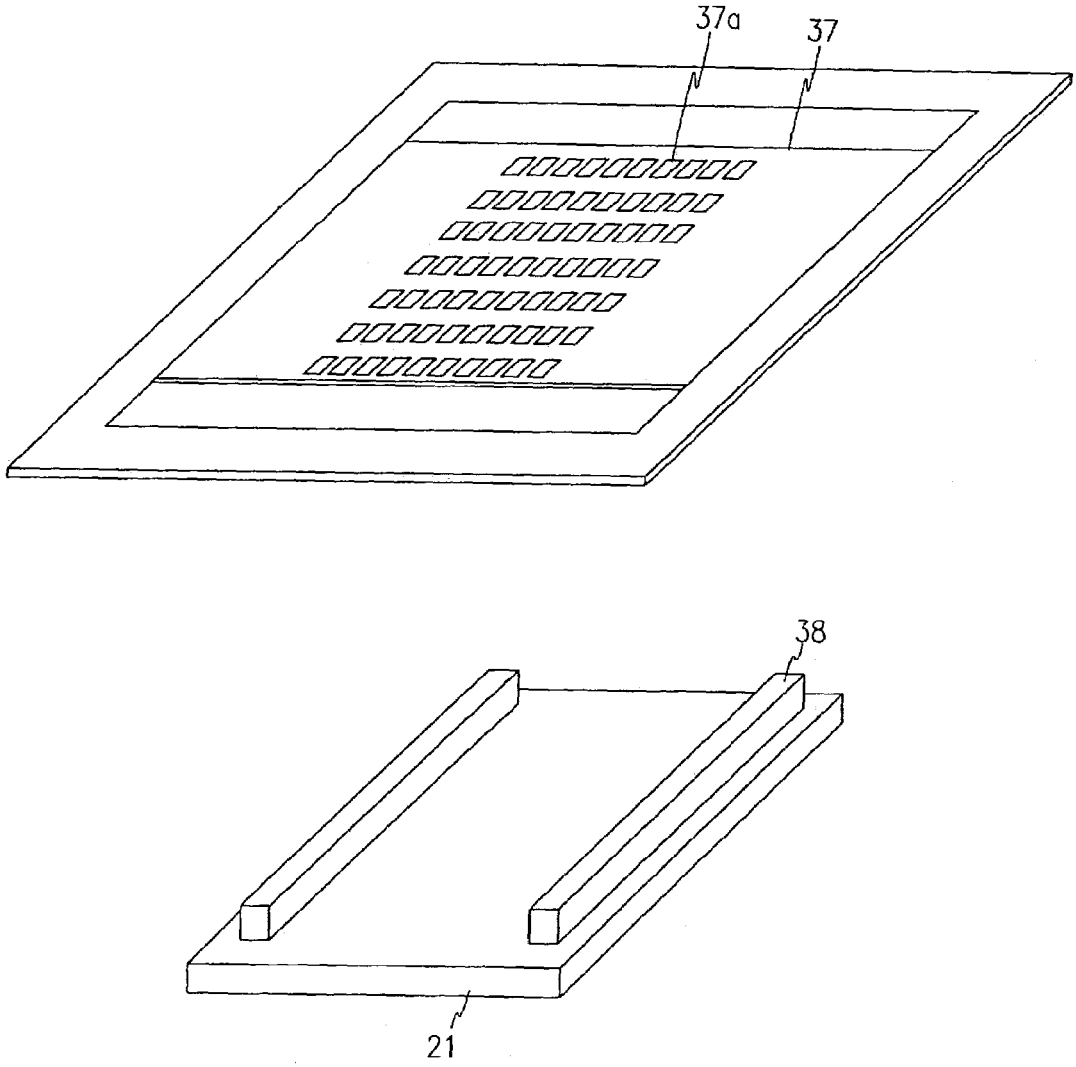
FIGS. 7 to 12 are perspective views showing sequential steps in manufacturing a field emission display according to an embodiment of the present invention.

Referring first to FIG. 7, the fixing rails 38 are secured on a substrate, which then becomes the rear substrate 21. The fixing rails 38 are magnetized after undergoing a blackening process, and are secured to the rear substrate 21 using frit.

Figure 8:
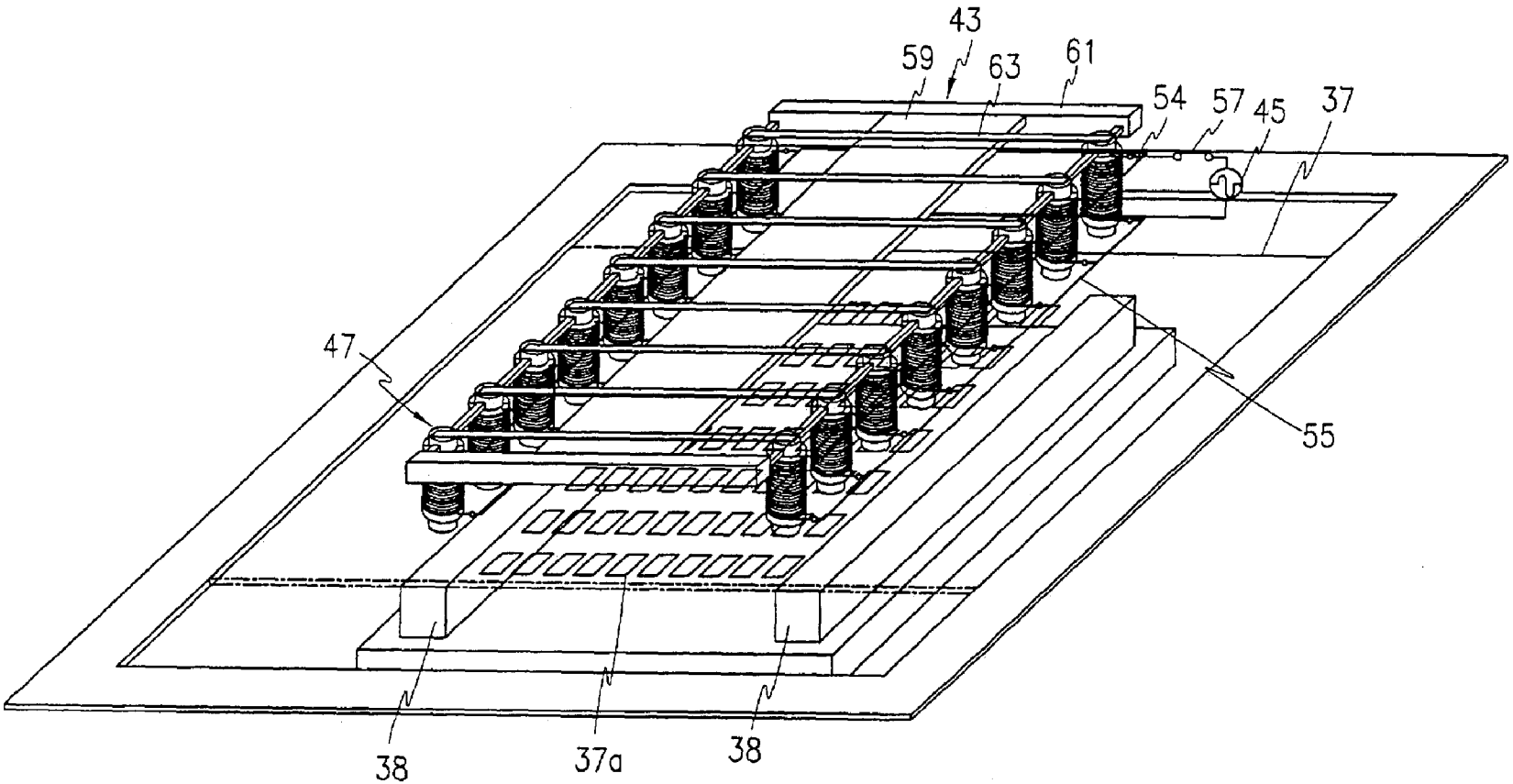

Next, with reference to FIG. 8, the metal grid 37 is positioned on the fixing rails 38. That is, the apertures 37*a* of the metal grid 37 are precisely positioned directly over the electron emission sources 31. So that the metal grid 37 does not move from this aligned position. The electromagnets 47 are positioned on the metal grid 37, then the metal grid 37 is secured to the fixing rails 38 in this state.

Subsequently, with reference to FIG. 9, welding is performed using a laser beam. In the case where the welding points are between the electromagnets, the manufacturing apparatus as described with reference to FIG. 4 is used, that is, the manufacturing apparatus including the electromagnets 47 is used. On the other hand, if the metal grid 37 becomes bent between the electromagnets to prevent welding from being performed in a satisfactory manner, the manufacturing apparatus as described with reference to FIG. 5 is used, that is, the manufacturing apparatus including the electromagnets 65 that have the cores 67 with the passages holes 67*a* formed therethrough is used.

Figure 9:
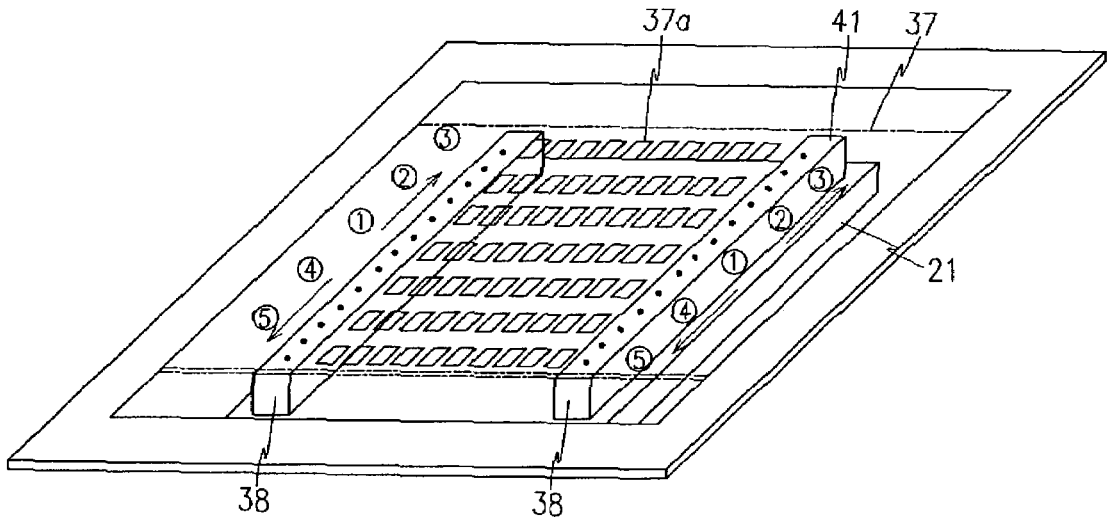

The order in which welding is performed along the fixing rails 38 is shown in FIG. 9. Welding is first performed at a center area of the fixing rails 38, then at predetermined intervals in one direction from the center weld then in the opposite direction from the center weld. It is preferred that the center welds for both the fixing rails 38 be made simultaneously so that the metal grid 37 is maintained in precise alignment.

Figure 10:
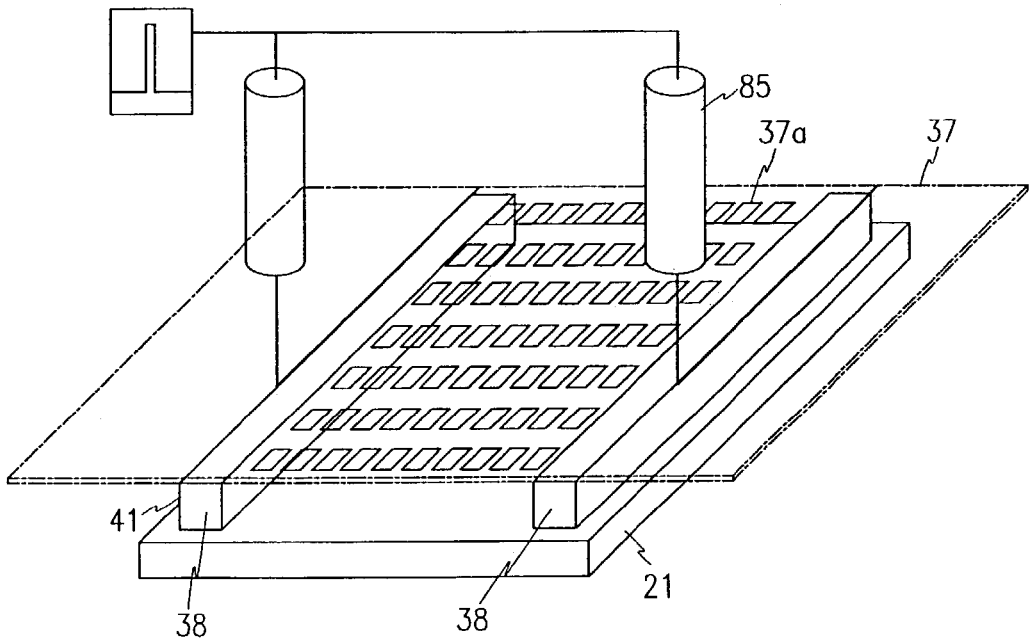

Referring now to FIG. 10, cutting is performed following the completion of welding. That is, the metal grid 37 is cut at areas outside the fixing rails 38 that do not correspond to a display or pixel region. Cutting is performed using lasers to prevent deformation of the metal grid 37 and so that an equal amount of tension is given to both sides of the metal grid 37 (i.e., to both welding areas of the metal grid 37). That is, a laser apparatus 85 that has a significantly greater output than the laser equipment used for welding is used to cut the metal grid 37.

If cutting is performed using the laser apparatus 85, the metal grid 37 is cut only at areas outside the pixel region by focus control of the laser optical system, cutoff control of the laser beam, and movement control of the substrate. Shock given to the substrate and other structural elements is also minimized through such control. The cutting of the metal grid 37 proceeds in the same sequence as the welding of the metal grid 37. In particular, the metal grid 37 is first cut at an area corresponding to a center of the fixing rails 38, then cutting is continued along one direction from this location then along the opposite direction.

Figure 11:
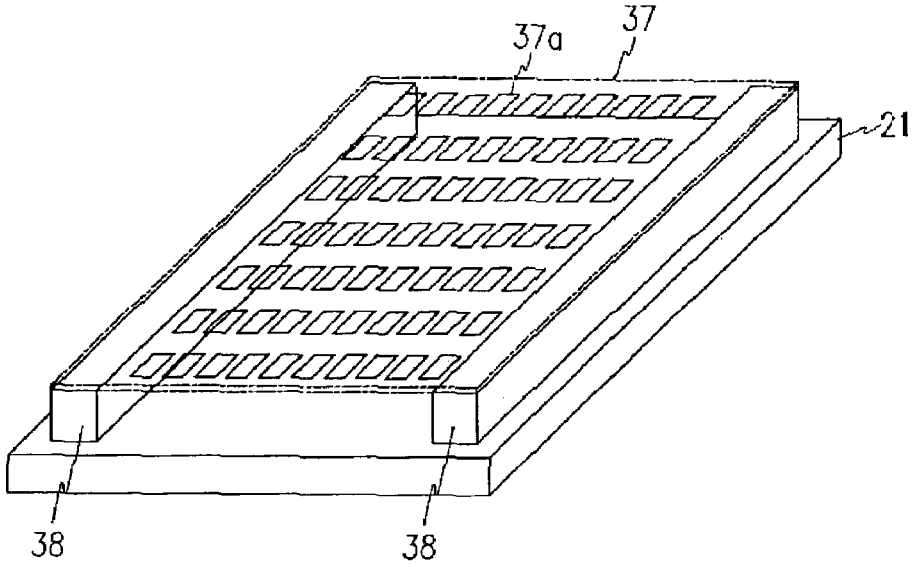

With reference to FIG. 11, after completing the cutting of the metal grid 37, as shown in FIG. 1, side glass elements 20, which are formed to a height extending past the metal grid 37, are mounted to the outside of the fixing rails 38. Then, the front substrate 23 having formed thereon the anode electrodes 33 and the phosphor layers 35 is provided on the side glass elements 20, as shown in FIG. 1. The front substrate 23 and the rear substrate 21 are sealed using the side glass elements 20 to thereby complete the FED.

A method of manufacturing a field emission display according to the second embodiment of the present invention now described. This method modifies only the fixing process of the above-mentioned manufacturing method.

Figure 12:
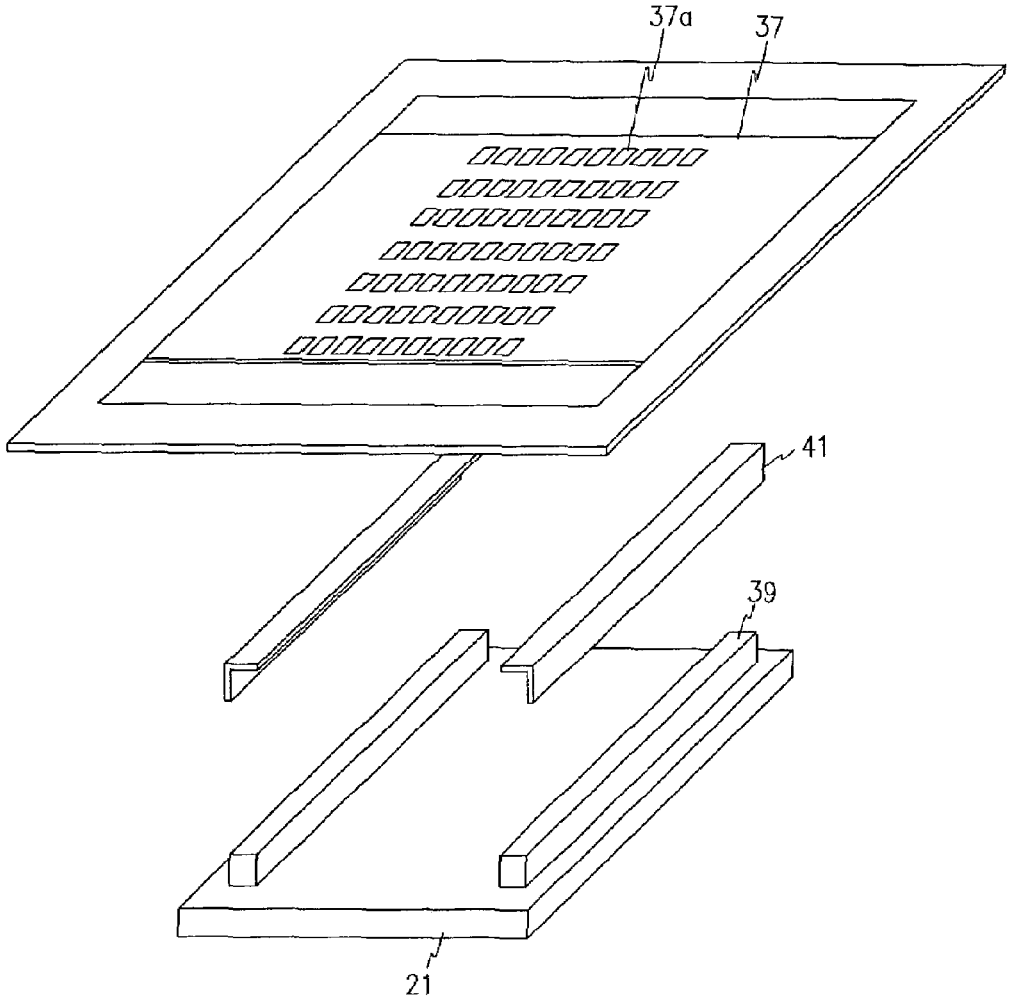
Figure 13:
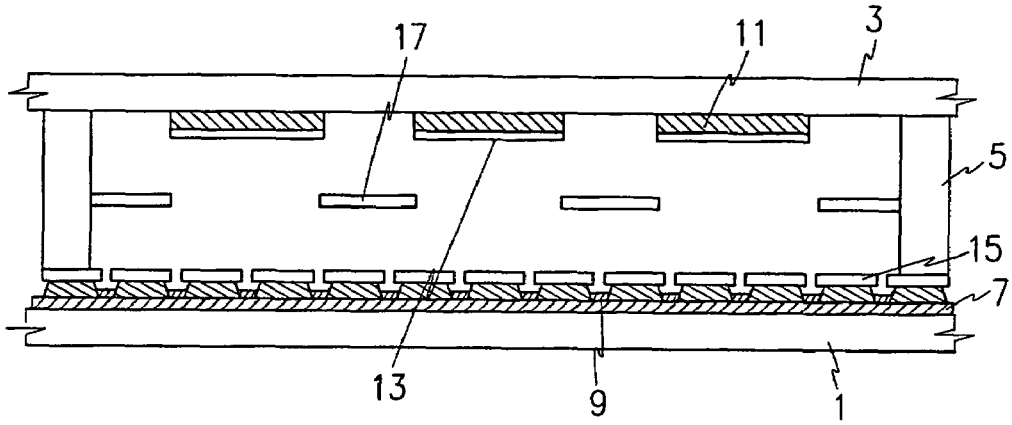
FIG. 13 (PRIOR ART)
FIG. 13 is a sectional view of a conventional field emission display.

Referring first to FIG. 12, the grid holders 39 are secured on a substrate, which then becomes the rear substrate 21, then the fixing brackets 41 are mounted on the grid holders 39. The fixing brackets 41 are magnetized after undergoing a blackening process, and are secured to the holders 39 using frit. Also, the fixing brackets 41 are bent at a substantially right angle so that they may endure the horizontal stress of the metal grid 37. The following processes are the same as the above-mentioned manufacturing method.

With the FED of the present invention structured as in the above, when the metal grid is secured to the rear substrate on which the fixing rails or the fixing brackets are mounted, the metal grid may be uniformly fixed in its position regardless of the size of the substrate, since the electromagnets contact only an upper surface of the metal grid.

Further, the metal grid is firmly secured to the fixing rails or the fixing brackets by a plurality of the electromagnets such that exceptional precision in welding is ensured and the quality of the welding itself is enhanced. Also, by cutting the metal grid using lasers, the possibility of damage to the rear substrate and other structural elements is minimized. Finally, sagging or other deformation of the metal grid is prevented by the manufacturing apparatus and method used in the present invention.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A field emission display, comprising:

a first substrate and a second substrate opposing one another with a predetermined gap therebetween;

cathode electrodes formed on the first substrate;

gate electrodes formed on the first substrate and insulated from the cathode electrodes by an insulating layer;

anode electrodes formed on a surface of the second substrate opposing the first substrate, and including phosphor layers formed thereon;

at least a pair of fixing rails secured to a surface of the first substrate facing the second substrate, the fixing rails having undergone a blackening process;

a plurality of fixing brackets formed on the fixing rails and bent around an edge of the fixing rails; and a metal grid between the first and second substrates and welded to an upper surface of the fixing brackets facing the second substrate.

2. The field emission display of claim 1, wherein the at least a pair of fixing rails are formed in a shape of a rod having a predetermined height.

3. The field emission display of claim 1, wherein a plurality of apertures are formed in the metal grid, each of the plurality of apertures corresponding to one of a plurality of electron emission sources.

4. A field emission display, comprising:

a first substrate and a second substrate opposing one another with a predetermined gap therebetween;

cathode electrodes formed on the first substrate;

gate electrodes formed on the first substrate and insulated from the cathode electrodes by an insulating layer;

anode electrodes formed on a surface of the second substrate opposing the first substrate, and including phosphor layers formed thereon;

at least a pair of grid holders secured to a surface of the first substrate facing the second substrate;

a plurality of fixing brackets formed on the grid holders, the fixing brackets having undergone a blackening process; and a metal grid between the first and second substrates and welded to an upper surface of the fixing brackets facing the second substrate, wherein the plurality of fixing brackets are bent around an edge of the grid holders.

5. The field emission display of claim 4, wherein a plurality of apertures are formed in the metal grid, each of the plurality of apertures corresponding to one of a plurality of electron emission sources.

6. A display, comprising:

a first substrate and a second substrate opposing one another with a predetermined gap therebetween;

an emission structure formed on the first substrate for emitting electrons;

an illumination structure formed on the first substrate for realizing a predetermined image;

at least a pair of fixing elements secured to a surface of the first substrate facing the second substrate; and a metal grid between the first and second substrates, wherein the fixing elements include at least a pair of grid holders formed along the two opposing edges of the first and second substrate, and fixing brackets formed on the at least a pair of grid holders having undergone a blackening process, and wherein the metal grid is welded to an upper surface of the fixing brackets facing the second substrate.

7. The display of claim 6, wherein each of the fixing elements is a fixing rail having undergone a blackening process.

8. The display of claim 6, wherein the display comprises a field emission display.

* * * * *